US009378915B2

(12) United States Patent
Augusta et al.

(10) Patent No.: US 9,378,915 B2
(45) Date of Patent: Jun. 28, 2016

(54) KNOB ELEMENT AND SLIDE ELEMENT OF AN ADJUSTING APPARATUS AND ADJUSTING APPARATUS AND METHOD FOR ADJUSTING A POSITION OF A THERMAL TRIPPING SHAFT

(71) Applicant: Siemens Aktiengesellschaft, Munich (DE)

(72) Inventors: Zbynek Augusta, Letohrad (CZ); Frank Himmelein, Weidenbach (DE); Filip Musil, Zachlumi (CZ)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 20 days.

(21) Appl. No.: 14/564,150

(22) Filed: Dec. 9, 2014

(65) Prior Publication Data

US 2015/0248985 A1 Sep. 3, 2015

(30) Foreign Application Priority Data

Feb. 28, 2014 (DE) ..... 10 2014 203 661

(51) Int. Cl.

| | |
|---|---|
| ***H01H 13/04*** | (2006.01) |
| ***H01H 61/01*** | (2006.01) |
| ***H01H 51/00*** | (2006.01) |
| ***H01H 89/00*** | (2006.01) |
| ***H01H 71/74*** | (2006.01) |
| *H01H 71/16* | (2006.01) |

(52) U.S. Cl.

CPC ..... *H01H 61/01* (2013.01); *H01H 51/00* (2013.01); *H01H 71/7427* (2013.01); *H01H 89/00* (2013.01); *H01H 71/16* (2013.01); *Y10T 292/57* (2015.04)

(58) Field of Classification Search

CPC ... H01H 71/40; H01H 72/2472; H01H 73/48; H01H 73/50; H01H 2071/042

USPC ..... 335/202

See application file for complete search history.

(56) References Cited

U.S. PATENT DOCUMENTS

| | | | | | |
|---|---|---|---|---|---|
| 3,084,236 | A * | 4/1963 | Klein | H01H 71/7463 | 335/10 |
| 3,156,796 | A * | 11/1964 | Vogelsberg | H01H 71/2472 | 335/37 |
| 3,264,435 | A * | 8/1966 | Klein | E04C 2/243 | 335/35 |
| 4,080,582 | A * | 3/1978 | Link | H01H 71/48 | 335/37 |
| 4,633,599 | A * | 1/1987 | Morell | A43C 11/16 | 24/68 SK |
| 4,748,726 | A * | 6/1988 | Schoch | A43C 11/16 | 24/68 B |
| 4,841,649 | A * | 6/1989 | Baggio | A43C 11/16 | 24/68 SK |

(Continued)

*Primary Examiner* — Shawki S Ismail

*Assistant Examiner* — Lisa Homza

(74) *Attorney, Agent, or Firm* — Harness, Dickey & Pierce, P.L.C.

(57) ABSTRACT

Embodiments of the present invention relate to a knob element and a slide element of an adjusting apparatus, to an adjusting apparatus, and to a method for adjusting a position of a thermal tripping shaft as well as to a thermal magnetic trip unit and an electrical switch for interrupting a current flow of an electric current in an electrical circuit in the event of the occurrence of a tripping event, having the adjusting apparatus, which has a rotatably mounted knob element and a tangentially movably mounted slide element. In at least one embodiment, the knob element and the slide element are operatively connected in such a way that the rotary movement of the knob element becomes a tangential movement of the slide element.

13 Claims, 5 Drawing Sheets

(56) References Cited

U.S. PATENT DOCUMENTS 4,884,760 A * 12/1989 Baggio ..... A43C 11/16 24/68 SK
5,042,177 A * 8/1991 Schoch ..... A43C 11/16 24/68 SK
5,152,038 A * 10/1992 Schoch ..... A43C 11/16 24/68 SK
5,600,874 A * 2/1997 Jungkind ..... A43C 11/16 24/68 SK
5,606,778 A * 3/1997 Jungkind ..... A43C 11/16 24/68 SK
5,638,588 A * 6/1997 Jungkind ..... A43C 11/16 24/68 SK
7,592,562 B1 * 9/2009 Vanderwege ..... H01H 19/14 200/336
2002/0158724 A1 * 10/2002 Wellner ..... H01H 71/02 335/16
2003/0038692 A1 * 2/2003 Schmalz ..... H02H 1/06 335/35
2004/0085167 A1 * 5/2004 McCormick ..... H01H 71/46 335/16
2008/0272869 A1 * 11/2008 Takayama ..... A61B 1/00188 335/219
2013/0187735 A1 * 7/2013 Augusta ..... H01H 77/06 335/18
2013/0187746 A1 * 7/2013 Augusta ..... H01H 89/00 337/3

* cited by examiner

KNOB ELEMENT AND SLIDE ELEMENT OF AN ADJUSTING APPARATUS AND ADJUSTING APPARATUS AND METHOD FOR ADJUSTING A POSITION OF A THERMAL TRIPPING SHAFT

PRIORITY STATEMENT

The present application hereby claims priority under 35 U.S.C. §119 to German patent application number DE 102014203661.5 filed Feb. 28, 2014, the entire contents of which are hereby incorporated herein by reference.

FIELD

At least one embodiment of the present invention generally relates to a knob element and to a slide element of an adjusting apparatus and to an adjusting apparatus and a method for adjusting a position of a thermal tripping shaft of a thermal tripping apparatus of an electrical switch. In addition, at least one embodiment of the present invention generally relates to a thermal magnetic trip unit of an electrical switch and to the electrical switch and in particular to a compact circuit breaker, for interrupting a current flow of an electric current in an electrical circuit in the event of the occurrence of a tripping event.

BACKGROUND

It is known in principle that compact circuit breakers (MCCB=Molded Case Circuit Breaker) are designed, for example, in accordance with the principle of magnetic repulsion or the interruption or disconnection of the contacts. In this case, the contacts open before the expected peak value of the short-circuit current is reached. By virtue of the disconnection of the contacts, the thermal loading and mechanical loading owing to the sudden short-circuit current of the system components, which can occur during a short circuit, are reduced considerably. A compact circuit breaker is used, for example, to implement a dual function, namely protection of an installation from overload and short-circuit currents and protection of lines and electrical operating means from damage as a result of ground faults, for example.

In order to protect an installation from overload currents or short-circuit currents, the compact circuit breaker, which can also be referred to as a thermal magnetic circuit breaker, has a thermal magnetic trip unit (TMTU). The thermal magnetic trip unit has a thermal tripping apparatus in order to protect the electrical circuit or an electrical apparatus from damage owing to an overload, and a magnetic tripping apparatus in order to protect the electrical circuit or an electrical apparatus from damage owing to a short circuit.

A short circuit and in particular an electrical short circuit is generally known as an accidental or unintentionally occurring conductive connection between two or more conductive parts and primarily between two nodes of the electrical circuit, as a result of which the electrical potential differences between these conductive parts drop to a value equal to zero or close to zero.

In particular, in respect of a compact circuit breaker, a short circuit is an abnormal connection between two isolated phases, which are intended to be isolated or insulated from one another. A short circuit results in the presence of an excessive electrical current, namely an overcurrent, which can result in damage to, overheating of, a fire in or even an explosion in the electrical circuit and/or the consumer. An overload is a less extreme state in comparison with the short circuit and is rather a long-term overcurrent state.

It is furthermore known in principle that the thermal tripping apparatus has, for example, a bimetallic element consisting of at least two metal strips rolled one on top of the other, each having different coefficients of thermal expansion. The electric current flows via a corresponding heating winding or along a tapering current conduction path for heating this bimetallic element, for example, wherein, owing to the different coefficients of thermal expansion of the metal strips, the bimetallic element is bent or curved when corresponding thermal energy is applied.

Owing to the bending movement of the bimetallic element, for example, control contacts are actuated or a latching mechanism of a circuit breaker is unlatched. The magnetic tripping apparatus or the electromagnetic tripping apparatus is constructed, for example, in such a way that, in the event of the occurrence of a short circuit or a short-circuit current, the electric current flowing via a current-conducting element is so great that a yoke element arranged on the current-conducting element generates a magnetic field, as a result of which, in turn, an armature element is attracted, for example.

Owing to the movement of the armature element, a latching mechanism of the circuit breaker is unlatched without delay, for example. The armature element or the armature is held in position in a known manner by a spring and in particular a tension spring, with the result that a movement of the armature element in the direction of the yoke element counter to the tensile force or spring force of the spring therefore can only take place in the case of the occurrence of a defined magnetic field strength and therefore a correspondingly triggering short-circuit current intensity. Compact circuit breakers are preferably power circuit breakers which can be switched on again after tripping owing to an overload or a short-circuit current.

In particular in respect of the different rated currents of the electrical circuit in which the electrical switch, in particular the compact circuit breaker, is arranged for interrupting a current flow of an electric current, it is necessary to be able to set the tripping characteristic or the tripping values, in particular as regards the response time, of the compact circuit breaker and in particular the thermal magnetic trip unit of the electrical switch. In the case of the presence of a thermal magnetic trip unit with one or more tripping shafts, it is known in principle that an adjustment of the tripping torque can take place by means of an axial movement or axial displacement of the individual tripping shafts. Such an axial displacement of the tripping shafts and in particular of the thermal tripping shaft and also of the magnetic tripping shaft is caused in this case, in a known manner, by a rotation or rotary movement of a setting element, such as a setting knob, for example. The corresponding knob is in this case connected to the tripping shaft via a pin.

In order to implement simple fitting of the individual parts, and also to take into consideration corresponding manufacturing tolerances of the individual component parts, it is possible in a known manner to arrange the individual component parts with respect to one another, or to connect them to one another, whilst maintaining corresponding interspaces or spacings. Such interspaces do, however, disadvantageously cause imprecise positioning of the individual component parts and in particular of the individual tripping shafts with respect to one another and also with respect to the remaining component parts of the thermal magnetic trip unit, which therefore in turn can result in imprecise setting or adjustment of the thermal magnetic trip unit and in particular the tripping shafts of the thermal magnetic trip unit.

The known configurations of the setting knob by way of a pin which engages in an engagement region of a tripping shaft and in particular the thermal shaft, also have the problem of a nonlinear translation of the rotary movement of the setting knob into a tangential or axial movement of the tripping shaft. Known adjustment mechanisms in this case have scaling of a rotary angle of at most 180°, wherein linear scaling along the rotation axis of the setting knob cannot be made possible, in particular since the axial movement of the tripping shafts is very low in a region of 0° or 180° of the rotary movement of the setting knob, in contrast to the axial movement of the tripping shaft in a region of 90° of the setting knob. Accordingly, linear scaling of the adjustment range of the setting knob would also not result in a linear axial movement or displacement of the tripping shaft.

SUMMARY

At least one embodiment of the present invention therefore resides in at least partially eliminating at least one of the above-described disadvantages in the case of an adjusting apparatus for adjusting a position of a tripping shaft and in particular a thermal tripping shaft of a thermal tripping apparatus.

In particular, at least one embodiment of the present invention is directed to a knob element of an adjusting apparatus, a slide element of an adjusting apparatus and an adjusting apparatus and a method for adjusting a position of a thermal tripping shaft of a thermal tripping apparatus of an electrical switch and a thermal magnetic trip unit of an electrical switch and an electrical switch, such as in particular a compact circuit breaker, by which linear scaling of the setting range of the knob element can be made possible in a simple and inexpensive manner, wherein a rotation of the knob element along the linear scaling of the setting range of the knob element results in a consequently linear axial movement of the tripping shaft and in particular of the thermal tripping shaft of the thermal tripping apparatus. The operation of the adjusting apparatus and in particular the knob element should therefore be more user friendly and more easily understandable.

At least one embodiment is directed to a knob element of an adjusting apparatus, a slide element of an adjusting apparatus and/or an adjusting apparatus for adjusting a position of a thermal tripping shaft. In addition, at least one embodiment is directed to a thermal magnetic trip unit of an electrical switch, an electrical switch and in particular a compact circuit breaker for interrupting a current flow of an electric current in an electrical circuit in the event of the occurrence of a tripping event and/or a method for adjusting a position of a thermal tripping shaft of a thermal tripping apparatus of an electrical switch.

BRIEF DESCRIPTION OF THE DRAWINGS

One embodiment of an adjusting apparatus known from the prior art and in particular of a thermal magnetic trip unit having the known adjusting apparatus and an embodiment of an adjusting apparatus according to at least one embodiment of the invention comprising an embodiment of a knob element according to at least one embodiment of the invention or an embodiment of a slide element according to at least one embodiment of the invention will be explained in more detail below with reference to drawings, in which, in each case schematically.

Elements with the same function and mode of operation are provided with the same reference symbols in FIGS. 1 to 10.

DETAILED DESCRIPTION OF THE EXAMPLE EMBODIMENTS

Figure 1:
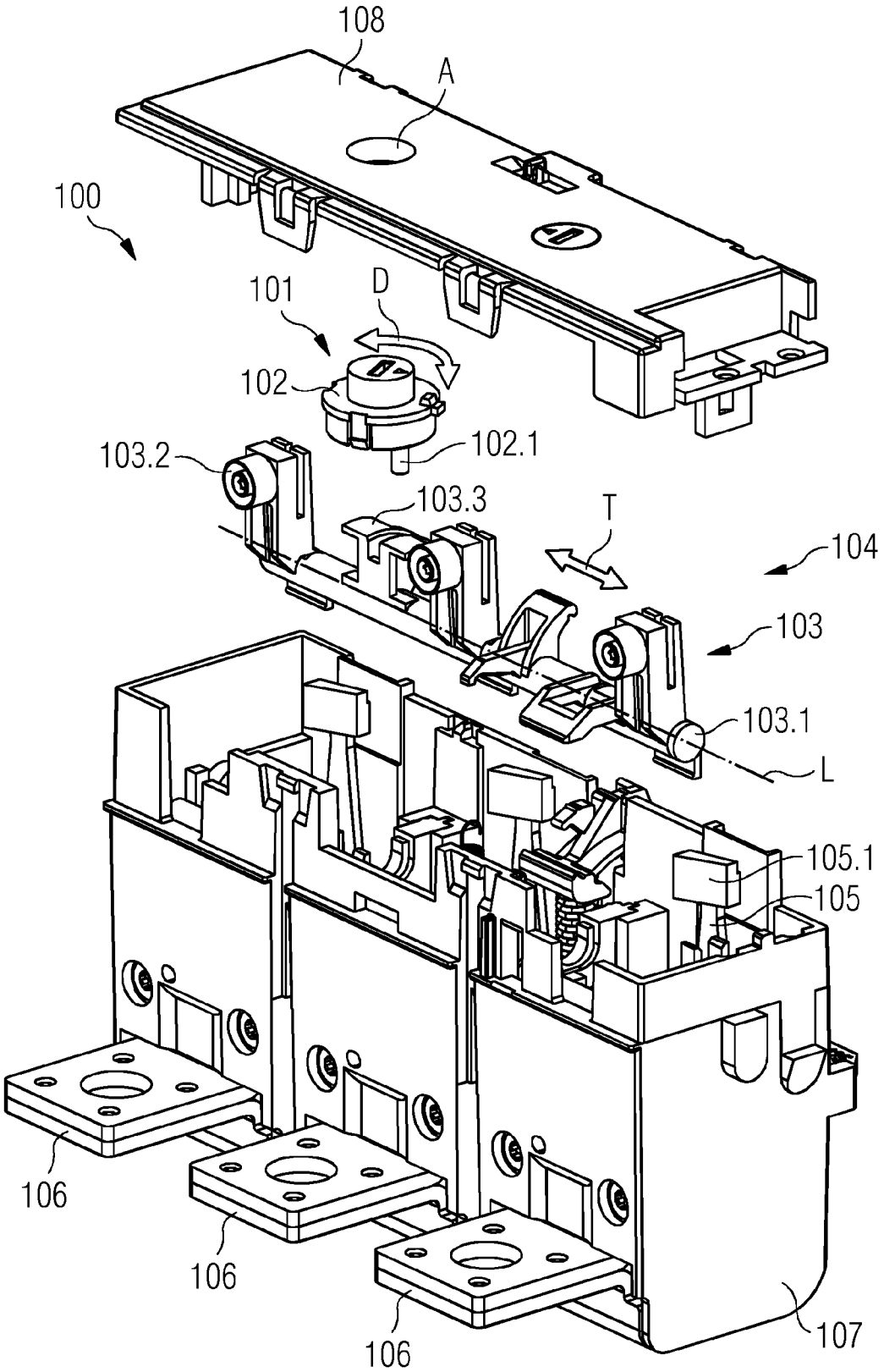
FIG. 1 shows a perspective view of a first embodiment of a thermal magnetic trip unit known from the prior art with an embodiment of an adjusting apparatus known from the prior art.

Various example embodiments will now be described more fully with reference to the accompanying drawings in which only some example embodiments are shown. Specific structural and functional details disclosed herein are merely representative for purposes of describing example embodiments. The present invention, however, may be embodied in many alternate forms and should not be construed as limited to only the example embodiments set forth herein.

Accordingly, while example embodiments of the invention are capable of various modifications and alternative forms, embodiments thereof are shown by way of example in the drawings and will herein be described in detail. It should be understood, however, that there is no intent to limit example embodiments of the present invention to the particular forms disclosed. On the contrary, example embodiments are to cover all modifications, equivalents, and alternatives falling within the scope of the invention. Like numbers refer to like elements throughout the description of the figures.

Before discussing example embodiments in more detail, it is noted that some example embodiments are described as processes or methods depicted as flowcharts. Although the flowcharts describe the operations as sequential processes, many of the operations may be performed in parallel, concurrently or simultaneously. In addition, the order of operations may be re-arranged. The processes may be terminated when their operations are completed, but may also have additional steps not included in the figure. The processes may correspond to methods, functions, procedures, subroutines, subprograms, etc.

Methods discussed below, some of which are illustrated by the flow charts, may be implemented by hardware, software, firmware, middleware, microcode, hardware description languages, or any combination thereof. When implemented in software, firmware, middleware or microcode, the program code or code segments to perform the necessary tasks will be stored in a machine or computer readable medium such as a storage medium or non-transitory computer readable medium. A processor(s) will perform the necessary tasks.

Specific structural and functional details disclosed herein are merely representative for purposes of describing example embodiments of the present invention. This invention may, however, be embodied in many alternate forms and should not be construed as limited to only the embodiments set forth herein.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments of the present invention. As used herein, the term "and/or," includes any and all combinations of one or more of the associated listed items.

It will be understood that when an element is referred to as being "connected," or "coupled," to another element, it can be directly connected or coupled to the other element or intervening elements may be present. In contrast, when an element is referred to as being "directly connected," or "directly coupled," to another element, there are no intervening elements present. Other words used to describe the relationship between elements should be interpreted in a like fashion (e.g., "between," versus "directly between," "adjacent," versus "directly adjacent," etc.).

The terminology used herein is for the purpose of describing particular embodiments only and is not intended to be limiting of example embodiments of the invention. As used herein, the singular forms "a," "an," and "the," are intended to include the plural forms as well, unless the context clearly indicates otherwise. As used herein, the terms "and/or" and "at least one of" include any and all combinations of one or more of the associated listed items. It will be further understood that the terms "comprises," "comprising," "includes," and/or "including," when used herein, specify the presence of stated features, integers, steps, operations, elements, and/or components, but do not preclude the presence or addition of one or more other features, integers, steps, operations, elements, components, and/or groups thereof.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art and will not be interpreted in an idealized or overly formal sense unless expressly so defined herein.

Portions of the example embodiments and corresponding detailed description may be presented in terms of software, or algorithms and symbolic representations of operation on data bits within a computer memory. These descriptions and representations are the ones by which those of ordinary skill in the art effectively convey the substance of their work to others of ordinary skill in the art. An algorithm, as the term is used here, and as it is used generally, is conceived to be a self-consistent sequence of steps leading to a desired result. The steps are those requiring physical manipulations of physical quantities. Usually, though not necessarily, these quantities take the form of optical, electrical, or magnetic signals capable of being stored, transferred, combined, compared, and otherwise manipulated. It has proven convenient at times, principally for reasons of common usage, to refer to these signals as bits, values, elements, symbols, characters, terms, numbers, or the like.

In the following description, illustrative embodiments may be described with reference to acts and symbolic representations of operations (e.g., in the form of flowcharts) that may be implemented as program modules or functional processes include routines, programs, objects, components, data structures, etc., that perform particular tasks or implement particular abstract data types and may be implemented using existing hardware at existing network elements. Such existing hardware may include one or more Central Processing Units (CPUs), digital signal processors (DSPs), application-specific-integrated-circuits, field programmable gate arrays (FPGAs) computers or the like.

Note also that the software implemented aspects of the example embodiments may be typically encoded on some form of program storage medium or implemented over some type of transmission medium. The program storage medium (e.g., non-transitory storage medium) may be magnetic (e.g., a floppy disk or a hard drive) or optical (e.g., a compact disk read only memory, or "CD ROM"), and may be read only or random access. Similarly, the transmission medium may be twisted wire pairs, coaxial cable, optical fiber, or some other suitable transmission medium known to the art. The example embodiments not limited by these aspects of any given implementation.

It should be borne in mind, however, that all of these and similar terms are to be associated with the appropriate physical quantities and are merely convenient labels applied to these quantities. Unless specifically stated otherwise, or as is apparent from the discussion, terms such as "processing" or "computing" or "calculating" or "determining" of "displaying" or the like, refer to the action and processes of a computer system, or similar electronic computing device/hardware, that manipulates and transforms data represented as physical, electronic quantities within the computer system's registers and memories into other data similarly represented as physical quantities within the computer system memories or registers or other such information storage, transmission or display devices.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

In particular, at least one embodiment of the present invention is directed to a knob element of an adjusting apparatus, a slide element of an adjusting apparatus and an adjusting apparatus and a method for adjusting a position of a thermal tripping shaft of a thermal tripping apparatus of an electrical switch and a thermal magnetic trip unit of an electrical switch and an electrical switch, such as in particular a compact circuit breaker, by which linear scaling of the setting range of the knob element can be made possible in a simple and inexpensive manner, wherein a rotation of the knob element along the linear scaling of the setting range of the knob element results in a consequently linear axial movement of the tripping shaft and in particular of the thermal tripping shaft of the thermal tripping apparatus. The operation of the adjusting apparatus and in particular the knob element should therefore be more user friendly and more easily understandable.

At least one embodiment is directed to a knob element of an adjusting apparatus, a slide element of an adjusting apparatus and/or an adjusting apparatus for adjusting a position of a thermal tripping shaft. In addition, at least one embodiment is directed to a thermal magnetic trip unit of an electrical switch, an electrical switch and in particular a compact circuit breaker for interrupting a current flow of an electric current in an electrical circuit in the event of the occurrence of a tripping event and/or a method for adjusting a position of a thermal tripping shaft of a thermal tripping apparatus of an electrical switch.

Further features and details of the invention are set forth in the dependent claims, the description and the drawings. In this case, features and details which have been described in connection with the knob element or the slide element of an adjusting apparatus do of course also apply in connection with the adjusting apparatus according to at least one embodiment of the invention, the thermal magnetic trip unit according to at least one embodiment of the invention, the electrical switch according to at least one embodiment of the invention and/or the method according to at least one embodiment of the invention for adjusting a position of a thermal tripping shaft, and vice versa in each case, with the result that, in respect of the disclosure, reciprocal reference is always or can always be made to the individual aspects of embodiments of the invention. Furthermore, the method for adjusting a position of a thermal tripping shaft can be implemented using the adjusting apparatus according to at least one embodiment of the invention, and in particular the knob element or slide element according to at least one embodiment of the invention of an adjusting apparatus.

The knob element according to at least one embodiment of the invention of an adjusting apparatus for adjusting a position of a thermal tripping shaft of a thermal tripping apparatus of an electrical switch for calibrating a tripping characteristic of the thermal tripping apparatus has a guide groove, which extends, at least sectionally, in the form of a spiral along a first surface, for guiding a guide pin of a slide element of the adjusting apparatus for transferring a movement onto the thermal tripping shaft. The knob element is in particular a setting element and advantageously a rotary knob or a rotary knob element, which is arranged at least sectionally outside a housing of a thermal magnetic trip unit in order in particular to be able to be actuated by an end user. The knob element advantageously has a circular-cylindrical shape, wherein the top faces of the knob element form a first and a second surface.

A guide groove extends along at least one of the first surfaces and in particular one of the first top faces of the knob element, which guide groove serves the purpose of receiving a guide pin of a slide element of an adjusting apparatus which will be described in more detail below. This guide groove or guiding slotted link for guiding a guide pin is advantageously configured in the form of a spiral and so as to form at least one semicircle. The first surface is oriented in the direction of the thermal magnetic trip unit, while the second surface and therefore the second top face of the knob element, which is opposite the first surface of the knob element, is oriented or arranged on an outer side of the housing of the thermal magnetic trip unit.

Within the scope of at least one embodiment of the invention, it is furthermore conceivable for the guide groove to have a substantially constantly increasing spacing starting from a knob element rotation axis of the knob element. Accordingly, the spiral of the guide groove has an advantageously uniform pitch. This means that the spacing existing between a wall of the guide groove and the knob element rotation axis increases substantially uniformly or constantly in the circumferential direction about the knob element rotation axis. However, it is also conceivable for the guide groove to have a spacing which does not constantly increase, starting from a knob element rotation axis of the knob element, with the result that the spiral of the guide groove has a substantially elliptical form or configuration. The depth of the guide groove of the knob element is dependent on the size or configuration of the guide pin of a slide element of the adjusting apparatus. Advantageously, the width of the guide groove is matched to the width and in particular the outer diameter of the guide pin of the slide element. On the basis of the substantially constantly increasing spacing of the guide groove and in particular the spiral of the guide groove, starting from a knob element rotation axis which is located in the center of the knob element and in particular the first surface of the knob element, advantageously a linear translation of the rotary movement of the knob element onto a tripping shaft and in particular the thermal tripping shaft in order to enable an axial movement of the thermal tripping shaft is made possible.

In order to compensate for manufacturing or production tolerances of the individual component parts and in particular the guide groove in respect of the width or depth thereof and the guide pin in respect of the diameter thereof as well in an advantageous manner, it is advantageously conceivable for the knob element to have a compensation groove, which at least sectionally surrounds the guide groove for producing a guide wall. By virtue of this compensation groove, advantageously a thin guide groove wall is produced, which is deformable or flexible and therefore makes it easier for a guide pin of the slide element, for example, to be received or introduced, and in particular makes this possible.

In addition, as a result, play-free running or play-free guidance of the guide pin is also enabled owing to the fact that the guide walls of the guide groove rest on the outer sides of the guide pin in an advantageous manner. Accordingly, the compensation groove, which can have a depth which is equal to or less than that of the guide groove and/or a width which is equal to or less than that of the guide groove, extends along an outer region of the guide groove and at least partially along and/or around the guide groove. The compensation wall or guide groove wall is therefore located between the guide groove and the compensation groove.

When the guide pin is introduced into the guide groove, this guide groove wall is advantageously moved or bent in the direction towards the compensation groove in order to make it possible to introduce the guide pin into the guide groove and also to facilitate play-free running of the pin and in particular the guide pin in the guide groove. Advantageously, by way of such a flexible guide groove wall, it is possible to introduce a guide pin with an outer diameter which is configured so as to be geometrically larger than the width of the guide groove.

Furthermore, a slide element of an adjusting apparatus for converting a rotary movement of a knob element of the adjusting apparatus about a knob element rotation axis into a translational movement of a thermal tripping shaft in the direction of a shaft rod longitudinal axis of the thermal tripping shaft is claimed. According to at least one embodiment of the invention, the slide element has at least one guide pin, which is arranged on a first surface of the slide element, for engaging in a guide groove in the knob element, and a transfer element, which is arranged on a second surface, which is opposite the first surface, of the slide element, for transferring the movement to the thermal tripping shaft. The slide element is advantageously configured as a flat element and in particular a plate-shaped element, whose first and second surfaces have a longer length and greater width than the side faces thereof. The guide pin of the slide element therefore extends away from the first surface and advantageously orthogonally away from the first surface and has an outer diameter which substantially corresponds to the width of the guide groove of the abovementioned knob element. The transfer element can advantageously be a transfer pin, which can engage in a corresponding receiving element of the thermal tripping shaft.

The slide element advantageously serves the purpose of enabling a linear adjustment scale over the entire adjustment angle of the knob element, wherein, advantageously, the adjustment angle of the knob element of also above 180° is possible, with the result that, advantageously, a very high degree of adjustment precision can be achieved. The transfer element can, however, also be in the form of a cutout itself or else in the form of a hook element or a comparably configured transfer element for transferring a kinetic energy starting from the knob element to a tripping shaft and in particular a thermal tripping shaft. Advantageously, with the slide element, the rotary movement implemented by the knob element and the rotational movement of the knob element about its knob element rotation axis enables this rotary movement to be converted into a translational movement and advantageously an axial movement of the thermal tripping shaft along the shaft rod longitudinal axis thereof.

Furthermore, it is conceivable for the transfer element to be arranged in a region of a slide element center point and/or for the guide pin to be arranged in a region spaced apart from the slide element center point. Advantageously, the slide element center point is the center of rotation of the slide element or the point of the rotation axis of the slide element which extends from a first surface of the slide element in the direction towards a second surface of the slide element. If the transfer element itself is configured in the form of a transfer pin, as a result this transfer pin extends in the region of the slide element center point and advantageously starting directly from the slide element center point, advantageously orthogonally, away from the second surface of the slide element, while the guide pin, which is arranged on a first surface of the slide element, advantageously extends orthogonally away from this first surface, with an offset with respect to the slide element center point.

However, it is also conceivable for the transfer pin of the slide element to advantageously extend orthogonally away from the second surface of the slide element in a region which is outside the region of the slide element center point, while in particular the guide pin is arranged in a region of the slide element center point and in particular directly on the slide element center point. Furthermore, it would also be conceivable for both pins, and in particular the transfer pin and the guide pin, to either each be arranged in the region of the slide element center point or directly on the slide element center point or both to be arranged outside the region of the slide element center point and therefore offset from the slide element center point.

Within the scope of at least one embodiment of the invention, it is furthermore conceivable for the slide element to have at least one sliding region, by which the slide element is guided in sliding fashion in a guide region of an adjusting apparatus. Advantageously, the slide element is therefore mounted in sliding fashion in a guide region of the adjusting apparatus, wherein the guide region of the adjusting apparatus can be arranged, for example, on a housing of the thermal magnetic trip unit.

The sliding region of the slide element advantageously serves the purpose of touching the guide regions and in particular a guide groove or else a guide rail of the adjusting apparatus in order to enable sliding and in particular delay-free and hooking-free sliding of the slide element within the guide region of the adjusting apparatus. The sliding region itself can also be configured, for example, in the form of a projection or a wall curvature of the slide element and in particular a peripheral region of the slide element, which extends between the first surface and the second surface of the slide element, wherein this projection or wall curvature region slides in the guide region of the adjusting apparatus. Advantageously, the sliding regions of the slide element serve to reduce friction during the sliding movement, with the result that play-free and at the same time simple and delay-free sliding of the slide element in the guide region can be enabled. Advantageously, as a result, the linear translation between the rotary movement of the knob element and the axial movement of the tripping shaft is enabled.

It is furthermore conceivable for the sliding regions themselves to be formed by a material tapering of the slide element, with the result that the wall region of the slide element which slides in the guide region of the adjusting apparatus and in particular the resting surface of these wall regions or guide wall regions of the slide element are therefore reduced, as a result of which, in turn, a reduction in friction during the movement of the slide element within the guide region of the adjusting apparatus is enabled.

It is furthermore conceivable for the sliding region of the slide element to be mounted at least sectionally flexibly. For this purpose, it is possible for the projections or else wall curvatures, which can form a sliding region, to comprise a flexible or deformable material, such as in particular a plastics material. It is furthermore possible for the slide element to have material cutouts for flexible mounting of the sliding regions, which material cutouts enable at least sectional bending or deformation of the slide element, with the result that, advantageously, in particular the guide walls or wall regions of the slide element which are mounted in sliding fashion in the guide region of the adjusting apparatus can be deformed along a defined region in the direction towards the slide element center. Such material cutouts can be configured, for example, in the form of a hole or a bore and in particular a through-bore or an aperture, wherein such a material cutout can have a different geometrical form, such as a slot or a round hole, for example.

In the case of the slide element according to at least one embodiment of the invention, all of the advantages which have already been described in respect of the knob element according to at least one embodiment of the invention of an adjusting apparatus in accordance with a preceding aspect of the invention result.

Furthermore, an adjusting apparatus for adjusting a position of a thermal tripping shaft of a thermal tripping apparatus of an electrical switch, having a rotatably mounted knob element and a tangentially movably mounted slide element is disclosed, wherein the knob element and the slide element are operatively connected in such a way that the rotary movement of the knob element becomes a tangential movement of the slide element. Accordingly, it is conceivable, for example, for the slide element and/or the tripping shaft or the thermal tripping shaft to be in the form of a toothed rack, such as, for example, a rounded toothed rack or a flat toothed rack, with the corresponding teeth of a pinion, which is arranged or applied on the knob element and in particular on a first surface of the knob element, for example, engaging in the teeth of said toothed rack. The pinion itself is therefore a small driving gearwheel, which interacts with the toothed rack.

It is furthermore possible for the adjusting apparatus to have at least one knob element and a slide element, wherein the slide element is arranged between the knob element and the thermal tripping shaft. Accordingly, the adjusting apparatus advantageously has a knob element of the type mentioned above and a slide element of the abovementioned type. Advantageously, the slide element has a guide pin, which engages in the guide groove arranged in the first surface of the knob element, with the result that, in the case of a rotation of the knob element about its knob element rotation axis, the guide pin of the slide element is moved in the guide groove, with the result that a deflection of the slide element and in particular a translational movement of the slide element within guide rails of the adjusting apparatus can be generated. On the basis of the translational movement of the slide element, or movement of the slide element which advantageously takes place in the axial direction of the shaft rod longitudinal axis of the tripping shaft and in particular of the thermal tripping shaft, advantageously the thermal tripping shaft itself, which is operatively connected to the slide element and in particular a transfer element, such as a transfer pin, of the slide element, is also moved.

In the case of the adjusting apparatus according to at least one embodiment of the invention, all of the advantages which have already been described above with respect to a knob element of an adjusting apparatus and/or a slide element of an adjusting apparatus in accordance with the preceding aspects of the invention result.

Furthermore, a thermal magnetic trip unit of an electrical switch for interrupting a current flow of an electric current in an electrical circuit in the event of the occurrence of a tripping event, having a magnetic tripping apparatus and a thermal tripping apparatus and an adjusting apparatus is disclosed. Accordingly, the thermal magnetic trip unit has at least one adjusting apparatus in accordance with the abovementioned type.

Furthermore, the thermal magnetic trip unit has a magnetic tripping apparatus, having at least one magnetic tripping shaft, which interacts with an armature, and in particular an impact armature or hinged armature, wherein this armature is deflected or set in motion by a magnetic field generated in a yoke element. The yoke element can advantageously also be a component part of the magnetic tripping apparatus itself and is connected to a current-conducting element for conducting the electric current.

The thermal tripping apparatus advantageously has at least one thermal tripping shaft and a bimetallic element, which interacts with the thermal tripping shaft and which bends owing to the metals of the bimetallic element having different coefficients of thermal expansion in the case of corresponding transfer of thermal energy, starting from the current-conducting elements for conducting the electric current, onto the bimetallic element. On the basis of the bending of the bimetallic element, contact is made between the bimetallic element and the thermal tripping shaft, as a result of which the thermal tripping shaft is deflected about a rotation axis. During the deflection of the thermal tripping shaft about its rotation axis, a tripping mechanism is activated or unlatched, as a result of which, in turn, advantageously a current flow in an electrical circuit is interrupted.

In the case of the thermal magnetic trip unit according to at least one embodiment of the invention, all of the advantages which have already been described in respect of a knob element of an adjusting apparatus, a slide element of an adjusting apparatus and/or an adjusting apparatus for adjusting a position of a thermal tripping shaft in accordance with the preceding aspects of the invention result.

Furthermore, an electrical switch and in particular a compact circuit breaker for interrupting a current flow of an electric current in an electrical circuit in the event of the occurrence of a tripping event, having a thermal magnetic trip unit, is disclosed. Accordingly, the electrical switch advantageously has a thermal magnetic trip unit in accordance with the abovementioned type. The electrical switch, which is advantageously a compact circuit breaker, is operatively connected to an electrical circuit in such a way that, in the event of the occurrence of the tripping event, which can be, for example, a short circuit or else an overload, the current flow of the electric current is interrupted in order to protect a consumer connected to the electrical circuit or a load from damage.

In the case of the electrical switch according to at least one embodiment of the invention, all of the advantages which have already been described with respect to a knob element of an adjusting apparatus, a slide element of an adjusting apparatus, an adjusting apparatus for adjusting a position of a thermal tripping shaft and/or a thermal magnetic trip unit in accordance with the preceding aspects of the invention result.

Furthermore, a method for adjusting a position of a thermal tripping shaft of a thermal tripping apparatus of an electrical switch in the direction of a shaft rod longitudinal axis of the thermal tripping shaft comprising an adjusting apparatus is disclosed, wherein the rotary movement of the rotatably mounted knob element is converted into a tangential movement of the tangentially movably mounted slide element. Advantageously, therefore, an adjusting apparatus in accordance with the abovementioned type is used in the method for adjusting a position of the thermal tripping shaft. In this case, it is conceivable for the adjusting apparatus to have a pinion, for example, whose teeth engage in a tooth rack element in order to convert a rotary movement of the knob element into a tangential movement and in particular an axial movement, which extends along the shaft rod longitudinal axis of the thermal tripping shaft. In this case, it is conceivable for in particular the slide element and/or the shaft rod of the thermal tripping shaft or a receiving element of the thermal tripping shaft to have, at least regionally, a toothed rack element.

Within the scope of at least one embodiment of the invention, however, it is furthermore possible for a knob element be rotated about its knob element rotation axis, as a result of which a guide pin, which is arranged in the guide groove of the knob element, of a slide element is moved along the guide groove, with the result that the slide element is moved translationally along a shaft rod longitudinal axis of the thermal tripping shaft, as a result of which the thermal tripping shaft, which is operatively connected to the slide element via a transfer element, is moved translationally along the shaft rod longitudinal axis. The shaft rod longitudinal axis of the thermal tripping shaft advantageously extends along the longitudinal axis of the rotation axis of the thermal tripping shaft. The transfer element can be, for example, a transfer pin, which extends away from a surface of the slide element, which surface is opposite the surface of the slide element from which the guide pin extends away. Advantageously, the transfer element and in particular the transfer pin engage in a receptacle or a receiving element of the thermal tripping shaft, wherein this receiving element itself can be configured in the form of a gap or a groove or a depression or a cutout or the like.

In the case of the method according to at least one embodiment of the invention, all of the advantages which have already been described in respect of a knob element of an adjusting apparatus, a slide element of an adjusting apparatus, an adjusting apparatus for adjusting a position of a thermal tripping shaft, a thermal magnetic trip unit and/or an electrical switch for interrupting a current flow of an electric current in an electrical circuit in accordance with the preceding aspects of the invention result.

Figure 2:
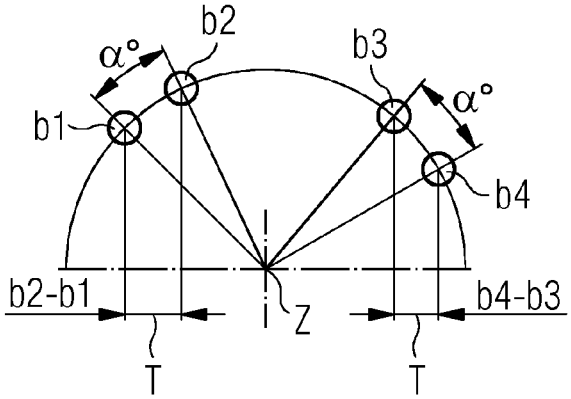
FIG. 2 shows a basic sketch of nonlinear scaling of the adjustment range of a setting knob of the adjusting apparatus known from the prior art.
Figure 3:
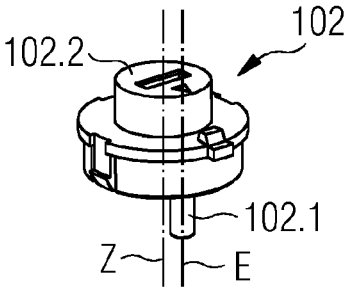
FIG. 3 shows a perspective view of an embodiment of a setting knob known from the prior art.

FIGS. 1 to 3 show, inter alia, a thermal magnetic trip unit 100 known from the prior art comprising an adjusting apparatus 101 and a knob element 102. Thus, FIG. 1 shows a perspective view of a thermal magnetic trip unit 100 known from the prior art which has a housing 107 comprising a cover 108 closing the housing, through which cover a plurality of current-conducting elements 106 is passed. A thermal tripping apparatus 104 (illustrated at least partially here), inter alia, is shown within the housing 107 of the thermal magnetic tripping unit 100, which thermal tripping apparatus has a thermal tripping shaft 103 and a plurality of and in particular three bimetallic elements 105.

The thermal tripping shaft 103 is moved along a longitudinal axis L of the shaft rod 103.1 in a translational direction T by way of an adjusting apparatus 101, which inter alia has a knob element 102 and an engagement region 103.3, which is arranged on the thermal tripping shaft 103. The knob element 102 has a pin 102.1, which extends in the direction of the engagement region 103.3 of the thermal tripping shaft 103, wherein a region of the knob element 102 which is arranged opposite the pin 102.1 can advantageously be passed through a cutout A in the cover 108, with the result that an end user can touch the knob element 102 in order to set it in rotary motion in a direction of rotation D. In accordance with the exemplary embodiment shown in FIG. 1 and known from the prior art of the adjusting apparatus 101, the pin 102.1 of the knob element 102 is introduced directly into the engagement region 103.3, which extends substantially orthogonally from the shaft rod 103.1 of the thermal tripping shaft 103 in the direction of the knob element 102. For this purpose, the engagement region 103.3 has in particular a cutout or a groove region, in which the pin 102.1 can be arranged.

Owing to a rotation of the knob element 102 in the direction of rotation D, in the clockwise direction or else in the counterclockwise direction, the pin 102.1 of the knob element 102 is likewise moved in the direction of rotation D, with the result that a movement of the thermal tripping shaft 103 at least sectionally in the translational direction T can take place thereby. However, in the case of the embodiment of the thermal magnetic trip unit 100 known from the prior art, as shown in FIG. 1, there is no linear conversion of the rotary movement D of the knob element 102 into a translational movement T of the thermal tripping shaft 103. This is explained in particular by means of the basic sketch shown in FIG. 2.

FIG. 2 shows a schematic view of the positions of the pin 102.1 of the knob element 102 (as illustrated in FIG. 1), which is moved along a movement path during a rotary movement D of the knob element 102 about its rotation axis Z or central axis Z. The reference symbols b1 to b4 in this case show the different positions of the pin 102.1. FIG. 2 thus shows that, in the case of a movement of the pin 102.1 from position b1 to position b2 and in particular from position b3 to position b4, despite an identical rotary movement D, or a rotary movement D of identical magnitude, of the knob element 102 about its rotation axis Z and in particular, therefore, in the case of an embodiment of an identical rotary angle of the knob element 102, the pin 102.1 moves in the translational direction T with a different movement distance, with the result that the thermal tripping shaft 103 therefore also experiences a translational movement T with a different magnitude. This different movement distance is shown in particular by means of the linkage of the reference symbols "b2-b1" and "b4-b3".

FIG. 3 shows a perspective view of an embodiment of a knob element 102 known from the prior art, which knob element is also used in the adjusting apparatus 101 of the thermal magnetic trip unit 100 shown in FIG. 1. The knob element 102 has a pin 102.1, which extends along an eccentric axis E substantially orthogonally away from a surface of the knob element 102, wherein the eccentric axis E is parallel to a central axis Z or a rotation axis Z of the knob element 102, but in particular spaced apart from this central axis Z. A touching region 102.2 of the knob element 102 is arranged opposite the pin 102.1, which touching region can be touched by the end user, in order to be able to rotate the knob element 102 in the direction of rotation D (cf. FIG. 1) about the central axis Z.

Figure 4:
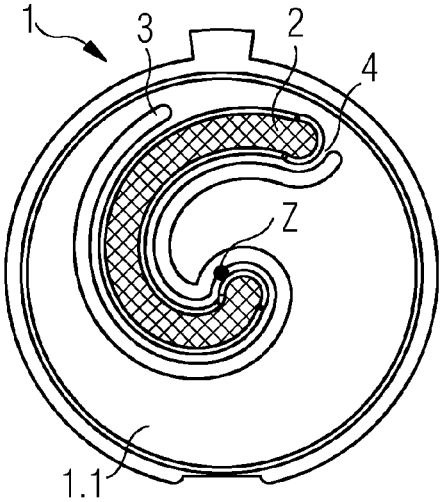
FIG. 4 shows a plan view of a first surface of an embodiment of a knob element according to the invention.

FIG. 4 shows a plan view of a first surface 1.1 of an embodiment of a knob element 1 according to the invention. The knob element 1 has a first surface 1.1 and a guide groove 2 arranged within the first surface 1.1. The guide groove 2 extends in the form of a spiral and so as to form at least one semicircle along the first surface 1.1 of the knob element 1, starting from a knob element rotation axis Z, which can also be referred to as central axis Z. In this case, the pitch of the guide groove 2 forming a spiral extends substantially continuously, starting from the knob element rotation axis Z.

Furthermore, the knob element 1 has a compensation groove 3, which is likewise formed in the region of the first surface 1.1 and in particular starting from the first surface 1.1 of the knob element into the material thickness thereof and at least partially surrounds or encompasses the guide groove 2. The guide groove 2 and the compensation groove 3 are oriented or arranged with respect to one another in such a way that a guide groove wall 4, which can also be referred to as compensation wall 4, is formed between the guide groove 2 and the compensation groove 3. Advantageously, this guide groove wall 4 is so narrow or thin that a pin which later runs in the guide groove 2 can achieve, at least temporarily, deformation of the guide wall 4, with the result that play-free sliding or guidance and in particular also low-friction sliding or guidance of the guide pin in this guide groove 2 is made possible.

Figure 5:
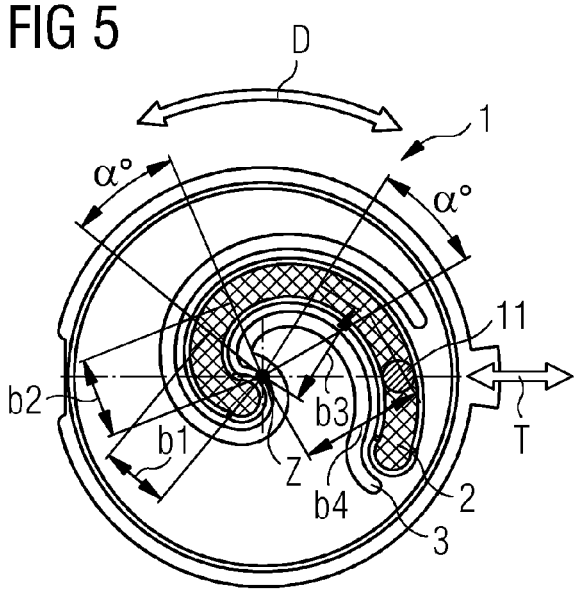
FIG. 5 shows a basic sketch of linear scaling of the adjustment range of the embodiment of the knob element according to the invention shown in FIG. 4.

FIG. 5 illustrates, as a basic sketch, the embodiment of the knob element 1 according to the invention shown in FIG. 4 with correspondingly applied lines of motion or position points of a guide pin 11, which can be arranged movably in a guide groove 2 of the knob element 1. Therefore, the reference symbols b1 to b4 illustrate the corresponding positions of a pin, such as, for example, a guide pin 11 of a slide element 10, as described for example below in FIG. 7, along its movement path within the guide groove 2. As can be seen from FIG.

5, during a movement of the knob element 1 about its knob element rotation axis Z and therefore during a rotary movement D of the knob element 1, a linear movement transfer between the rotary movement D of the knob element 1 about its knob element rotation axis Z and a tangential movement of the guide pin 11 starting from the knob element rotation axis Z takes place. This means that, on consideration of the comparatively dimensioned angles α, a movement distance of the guide pin which is equal in magnitude in the range of the spacings illustrated by the reference symbols "b2-b1" and "b4-b3" is completed.

Figure 6:
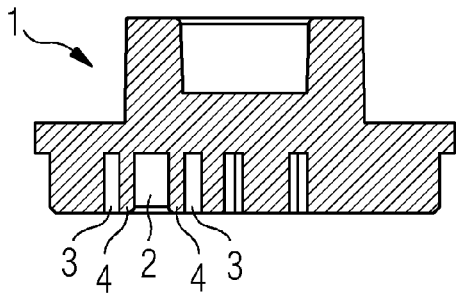
FIG. 6 shows a sectional illustration, from the side, of the embodiment of the knob element according to the invention shown in FIG. 4.

FIG. 6 shows a sectional illustration, from the side, of the embodiment of the knob element 1 according to the invention shown in FIGS. 4 and 5. As is clear from FIG. 6, the compensation groove 3 is arranged so as to be spaced apart from the guide groove 2 and/or so as to surround said guide groove 2 in such a way that a corresponding guide groove wall 4 is produced between the guide groove 2 and the compensation groove 3. The guide groove 2 and the compensation groove 3 have a comparable depth, but not a comparable width, as shown in the embodiment shown in FIG. 6. However, it is also possible for the depth of the guide groove 2 which extends into the material thickness of the knob element 1 not to correspond to the depth of the compensation groove 3 or for the width of the guide groove 2 to be identical to the width of the compensation groove 3.

Figure 7:
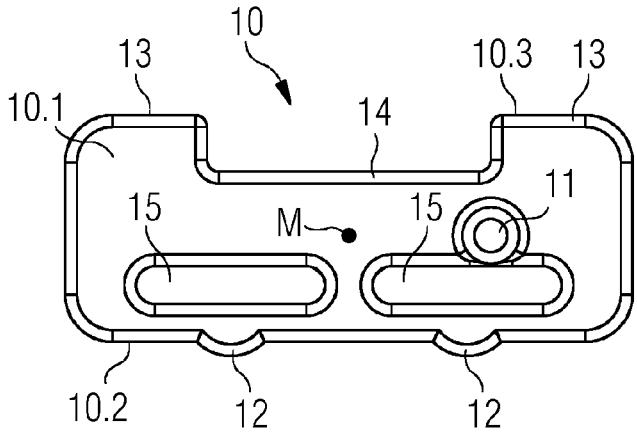
FIG. 7 shows a plan view of an embodiment of the slide element according to the invention.

FIG. 7 shows a plan view of a first surface 10.1 of an embodiment of a slide element 10 according to the invention. The slide element 10 has a guide pin 11, which extends substantially orthogonally away, starting from the first surface 10.1. The guide pin 11 is advantageously arranged in a region spaced apart from a slide element center point M. Furthermore, the slide element 10 has sliding regions 12 and 13 in the region of guide walls 10.2 and 10.3. In this case, it is conceivable for in particular the sliding region 12 to be configured in the form of a projection and in particular a material bulge, which extends away outwards starting from the guide wall 10.2. It is furthermore conceivable for one of the sliding regions, as shown by the reference symbol 13, to be in the form of a material cutout 14, which extends inwards into a central region of the slide element 10, starting from the guide wall 10.3. Advantageously, the contact zones of the sliding regions 12 and 13 are offset with respect to one another, with the result that simple and canting-free sliding of the slide element within a guide region, as shown in particular in FIG. 8, can be made possible. Within the scope of the invention, the contact zones are those zones of the slide element 10 with which the slide element 10 is in contact with at least one region or wall of the guide region.

In order to compensate for corresponding manufacturing tolerances of the slide element 10 and in particular the individual sliding regions 12 and 13 of the slide element 10, it is conceivable for the slide element 10 to have at least one and advantageously two or more cutouts 15, which, as shown in FIG. 7, are configured in the form of bores and in particular slot-shaped bores. On the basis of these cutouts 15, it is possible for the sliding regions 12 and 13 to be able to be deformed in the direction of the central region of the slide element 12 by virtue of the cutouts being compressed, for example.

Figure 8:
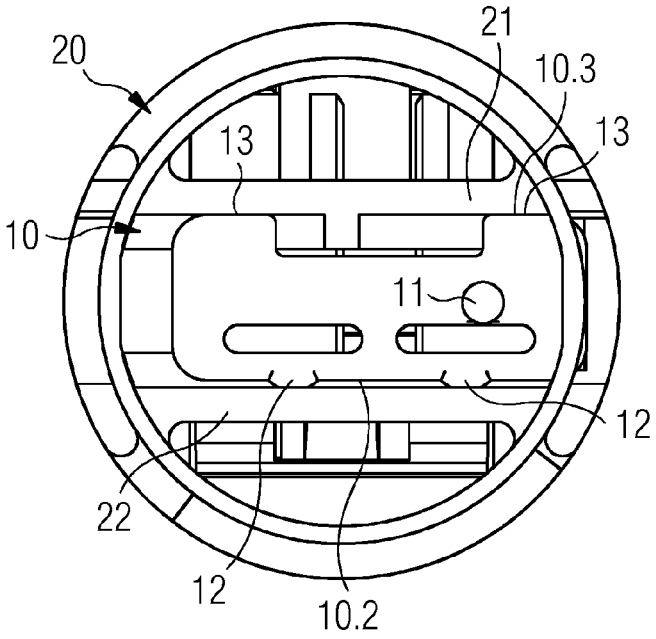
FIG. 8 shows a plan view of an arrangement of the embodiment of a slide element according to the invention shown in FIG. 7 in a guide region of a thermal magnetic trip unit.

FIG. 8 therefore shows the arrangement of the embodiment of the slide element 10 according to the invention shown in FIG. 7 in a guide region 20 of an adjusting apparatus, wherein the guide region 20 has a first guide wall 21 and a second guide wall 22, between which the slide element 10 is arranged and is mounted in sliding fashion.

Advantageously, the first guide wall 21 and the second guide wall 22 are configured in the form of guide rails or guide slotted links or cutouts or grooves. The slide element 10 is touched by the first guide wall 21 or the second guide wall 22 of the guide region 20 advantageously only via the sliding regions 12 and 13, respectively, and in particular the contact zones thereof.

Figure 9:
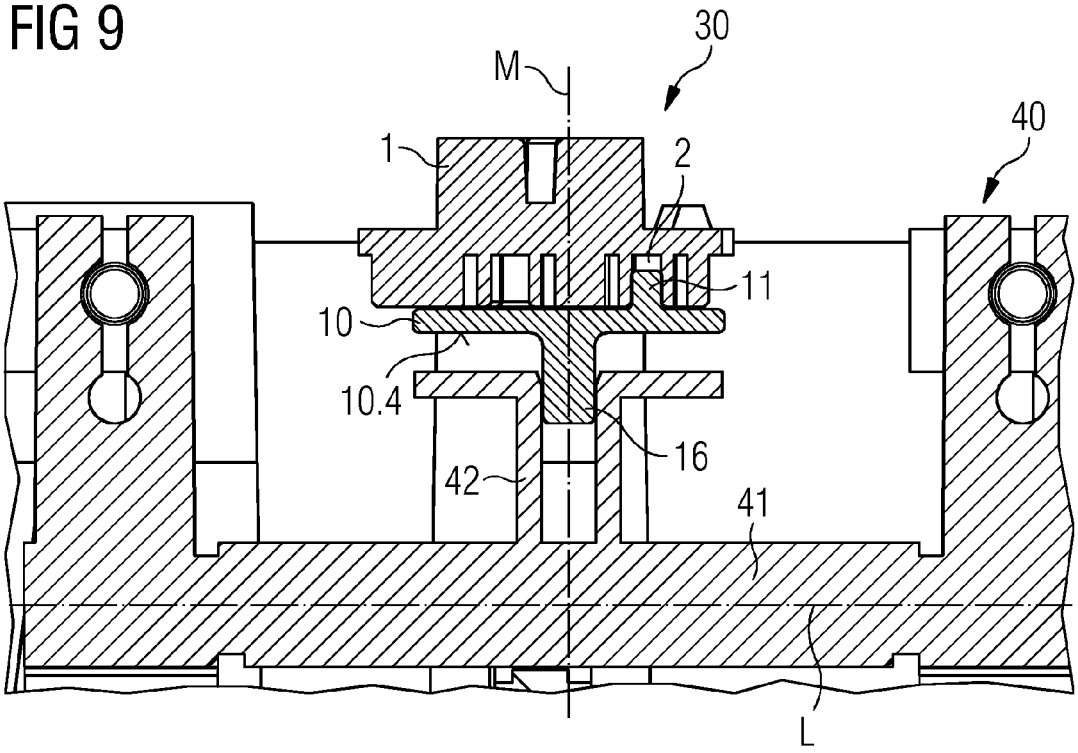
FIG. 9 shows a sectional illustration, from the side, of an arrangement of the embodiment of the knob element according to the invention shown in FIGS. 4 and 6 with the embodiment of the slide element according to the invention shown in FIGS. 7 and 8 in a region of a thermal tripping shaft of the thermal magnetic trip unit.

FIG. 9 shows a sectional illustration, from the side, of an arrangement of an embodiment of a knob element 1 according to the invention shown in FIGS. 4 to 6, for example, in conjunction with an embodiment of a slide element 10 shown in FIGS. 7 and 8 with a thermal tripping shaft 40. The guide pin 11 of the slide element 10 in this case engages in a guide groove 2 in the knob element 1, while a transfer element 16, which may be configured in the form of a transfer pin, for example, engages in an engagement region 42 of the thermal tripping shaft 40, which extends away from the shaft rod 41 of the thermal tripping shaft 40 in the direction of the knob element 1. While the guide pin 11 is arranged in a region spaced apart from the slide element center point M, the transfer element 16 and in particular the transfer pin is arranged in a region of the slide element center point M and in particular on the axis of the slide element center point M and advantageously extends orthogonally away from the second surface 10.4 of the slide element 10.

Figure 10:
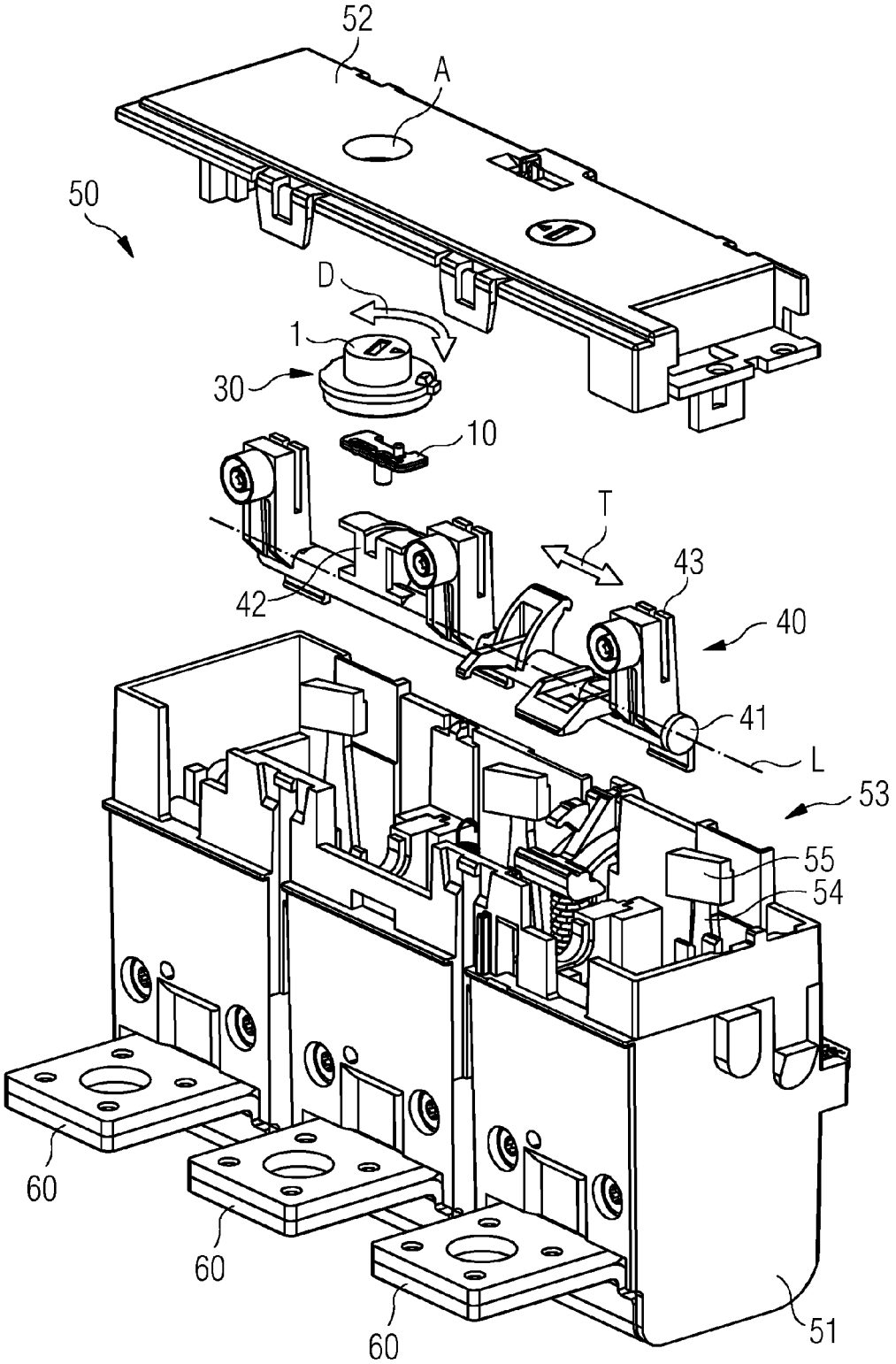
FIG. 10 shows a perspective view of an embodiment of a thermal magnetic trip unit according to the invention.

FIG. 10 shows a perspective view of an embodiment of a thermal magnetic trip unit 50 according to the invention, which has an adjusting apparatus 30, as shown in FIG. 9, for example. The thermal magnetic trip unit 50 has a housing 51 and a cover 52 capable of covering the housing 51, which cover has at least one cutout A, through which at least one region of the knob element 1 can be passed in order to enable an adjustment of the knob element 1 in the direction of rotation D by an end user. At least one current-conducting element 60 and advantageously three current-conducting elements 60, for example in the case of the presence of a three-phase thermal magnetic trip unit 50, is/are passed at least sectionally through the housing 51. Inter alia, a magnetic tripping apparatus (not shown here) and a thermal tripping apparatus 53 (shown at least partially here) are arranged within the housing 51, which thermal tripping apparatus has a thermal tripping shaft 40 and at least one bimetallic element 54 and advantageously three bimetallic elements 54.

A top region 55 is arranged at one end of the bimetallic element 54 and enters into operative contact with a contact region 43 of the thermal tripping shaft 40 in the event of the occurrence of a tripping event, i.e. in the event of the occurrence of an overload and consequently when the bimetallic element 54 experiences bending owing to the thermal energy. A slide element 10 is arranged between the knob element 1 and the engagement region 42 of the thermal tripping shaft 40, which slide element has a guide pin 11 (cf., for example, FIG. 9), which engages in a corresponding guide groove in the knob element 1, while a transfer element 16 of the slide element 10 (cf., for example, FIG. 9) engages in the engagement region 42 of the thermal tripping shaft 40. Owing to a movement and in particular a rotary movement of the knob element 1 in the direction of rotation D, the thermal tripping shaft 40 is moved or deflected in the translational direction T.

The patent claims filed with the application are formulation proposals without prejudice for obtaining more extensive patent protection. The applicant reserves the right to claim even further combinations of features previously disclosed only in the description and/or drawings.

The example embodiment or each example embodiment should not be understood as a restriction of the invention. Rather, numerous variations and modifications are possible in the context of the present disclosure, in particular those variants and combinations which can be inferred by the person skilled in the art with regard to achieving the object for example by combination or modification of individual features or elements or method steps that are described in connection with the general or specific part of the description and are contained in the claims and/or the drawings, and, by way of combinable features, lead to a new subject matter or to new method steps or sequences of method steps, including insofar as they concern production, testing and operating methods.

References back that are used in dependent claims indicate the further embodiment of the subject matter of the main claim by way of the features of the respective dependent claim; they should not be understood as dispensing with obtaining independent protection of the subject matter for the combinations of features in the referred-back dependent claims. Furthermore, with regard to interpreting the claims, where a feature is concretized in more specific detail in a subordinate claim, it should be assumed that such a restriction is not present in the respective preceding claims.

Since the subject matter of the dependent claims in relation to the prior art on the priority date may form separate and independent inventions, the applicant reserves the right to make them the subject matter of independent claims or divisional declarations. They may furthermore also contain independent inventions which have a configuration that is independent of the subject matters of the preceding dependent claims.

Further, elements and/or features of different example embodiments may be combined with each other and/or substituted for each other within the scope of this disclosure and appended claims.

Still further, any one of the above-described and other example features of the present invention may be embodied in the form of an apparatus, method, system, computer program, tangible computer readable medium and tangible computer program product. For example, of the aforementioned methods may be embodied in the form of a system or device, including, but not limited to, any of the structure for performing the methodology illustrated in the drawings.

Even further, any of the aforementioned methods may be embodied in the form of a program. The program may be stored on a tangible computer readable medium and is adapted to perform any one of the aforementioned methods when run on a computer device (a device including a processor). Thus, the tangible storage medium or tangible computer readable medium, is adapted to store information and is adapted to interact with a data processing facility or computer device to execute the program of any of the above mentioned embodiments and/or to perform the method of any of the above mentioned embodiments.

The tangible computer readable medium or tangible storage medium may be a built-in medium installed inside a computer device main body or a removable tangible medium arranged so that it can be separated from the computer device main body. Examples of the built-in tangible medium include, but are not limited to, rewriteable non-volatile memories, such as ROMs and flash memories, and hard disks. Examples of the removable tangible medium include, but are not limited to, optical storage media such as CD-ROMs and DVDs; magneto-optical storage media, such as MOs; magnetism storage media, including but not limited to floppy disks (trademark), cassette tapes, and removable hard disks; media with a built-in rewriteable non-volatile memory, including but not limited to memory cards; and media with a built-in ROM, including but not limited to ROM cassettes; etc. Furthermore, various information regarding stored images, for example, property information, may be stored in any other form, or it may be provided in other ways.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

LIST OF REFERENCE SYMBOLS

1 Knob element
1.1 First surface
2 Guide groove
3 Compensation groove
4 Guide groove wall/compensation wall
10 Slide element
10.1 First surface
10.2 Guide wall
10.3 Guide wall
10.4 Second surface
11 Guide pin
12 Sliding region
13 Sliding region
14 Material cutout
15 Cutout
16 Transfer element
20 Guide region
21 First guide wall
22 Second guide wall
30 Adjusting apparatus
40 Thermal tripping shaft
41 Shaft rod of thermal tripping shaft
42 Engagement region of thermal tripping shaft
43 Contact region of thermal tripping shaft
50 Thermal magnetic trip unit
51 Housing
52 Cover
53 Thermal tripping apparatus
54 Bimetallic element
55 Top region of bimetallic element
60 Current-conducting element
100 Thermal magnetic trip unit (prior art)
101 Adjusting apparatus (prior art)
102 Knob element (prior art)
102.1 Pin of knob element
102.2 Touching region of knob element
103 Thermal tripping shaft (prior art)
103.1 Shaft rod of thermal tripping shaft
103.2 Contact region of thermal tripping shaft
103.3 Engagement region of thermal tripping shaft
104 Thermal tripping apparatus (prior art)
105 Bimetallic element (prior art)
105.1 Top region of bimetallic element
106 Current-conducting element (prior art)
107 Housing (prior art)
108 Cover (prior art)
A Cutout
b1 First position of guide pin
b2 Second position of guide pin
b3 Third position of guide pin
b4 Fourth position of guide pin
D Direction of rotation
E Eccentric axis of knob element
L Longitudinal axis/shaft rod longitudinal axis
M Slide element center point T Translational direction
Z Knob element rotation axis/central axis
α Angle/rotary angle

What is claimed is:

1. A knob element of an adjusting apparatus for adjusting a position of a thermal tripping shaft of a thermal tripping apparatus of an electrical switch for calibrating a tripping characteristic of the thermal tripping apparatus, the knob element comprising:

a guide groove, extending, at least sectionally, in the form of a spiral along a first surface, to guide a guide pin of a slide element of the adjusting apparatus to transfer a movement onto the thermal tripping shaft (40).

2. The knob element of claim 1, wherein the guide groove includes a substantially constantly increasing spacing starting from a knob element rotation axis of the knob element.

3. The knob element of claim 1, wherein the knob element includes a compensating groove, which at least sectionally surrounds the guide groove for producing a guide groove wall.

4. An adjusting apparatus for adjusting a position of a thermal tripping shaft of a thermal tripping apparatus of an electrical switch, comprising:

the rotatably mounted knob element of claim 1; and a tangentially movably mounted slide element, wherein the knob element and the slide element are operatively connected in such a way that the rotary movement of the knob element becomes a tangential movement of the slide element.

5. The adjusting apparatus of claim 4, wherein the slide element is arranged between the knob element and the thermal tripping shaft.

6. A slide element of an adjusting apparatus for converting a rotational movement of a knob element of the adjusting apparatus about a knob element rotation axis into a translational movement of a thermal tripping shaft in the direction of a shaft rod longitudinal axis of the thermal tripping shaft, the slide element comprising:

at least one guide pin, arranged on a first surface of the slide element, to engage in a guide groove in the knob element; and a transfer element, arranged on a second surface opposite the first surface of the slide element, to transfer the movement to the thermal tripping shaft.

7. The slide element of claim 6, wherein at least one of the transfer element is arranged in a region of a slide element center point, and the guide pin is arranged in a region spaced apart from the slide element center point.

8. The slide element of claim 7, wherein the slide element includes at least one sliding region, by which the slide element is guidable in sliding fashion in a guide region of an adjusting apparatus.

9. The slide element of claim 8, wherein the sliding region of the slide element is mounted at least sectionally flexibly.

10. The slide element of claim 6, wherein the slide element includes at least one sliding region, by which the slide element is guidable in sliding fashion in a guide region of an adjusting apparatus.

11. The slide element of claim 10, wherein the sliding region of the slide element is mounted at least sectionally flexibly.

12. An adjusting apparatus for adjusting a position of a thermal tripping shaft of a thermal tripping apparatus of an electrical switch, comprising:

a rotatably mounted knob element; and a tangentially movably mounted slide element, the slide element being the slide element of claim 6, wherein the knob element and the slide element are operatively connected in such a way that the rotary movement of the knob element becomes a tangential movement of the slide element.

13. The adjusting apparatus of claim 12, wherein the slide element is arranged between the knob element and the thermal tripping shaft.

* * * * *